US005201915A

United States Patent [19]

Ricci

[11] Patent Number: 5,201,915

[45] Date of Patent: Apr. 13, 1993

[54] PROCESS FOR FADING DYED TEXTILE PRODUCTS AND FADED PRODUCTS MANUFACTURED ACCORDING TO THE PROCESS

[75] Inventor: Francesco Ricci, Santarcangelo di Romagna, Italy

[73] Assignee: Golden Trade S.r.l., Italy

[21] Appl. No.: 728,216

[22] Filed: Jul. 11, 1991

[30] Foreign Application Priority Data

Jul. 11, 1990 [IT] Italy ..... 20901 A/90

[51] Int. Cl.[5] ..... D06P 5/12; D06L 3/6; D06L 3/11

[52] U.S. Cl. ..... 8/447; 8/479; 8/482; 8/107; 8/108.1; 8/111

[58] Field of Search ..... 8/447, 482, 107, 479, 8/111

[56] References Cited

U.S. PATENT DOCUMENTS

| | | | |
|---|---|---|---|
| 1,553,721 | 9/1925 | Scholz | 8/447 |
| 1,829,645 | 10/1931 | Gibbens | 8/483 |
| 4,308,633 | 1/1982 | van Huffel et al. | 8/447 |
| 4,675,023 | 6/1987 | Hyink | 8/447 |
| 4,740,213 | 4/1988 | Ricci | 8/108.1 |
| 4,881,941 | 11/1989 | Dixon | 8/482 |
| 5,019,131 | 5/1991 | Nitsch | 8/457 |

*Primary Examiner*—A. Lionel Clingman
*Attorney, Agent, or Firm*—Hale and Dorr

[57] ABSTRACT

A process for fading dyed textile products in a non-uniform way includes: coating the surface of the textile product to be discolored with a layer of a product resistant to the discoloring or bleaching agent; breaking-up such a layer, preferably in a random way; and treating the resulting textile product with a solution of a bleaching and/or discoloring agent. The textile product so obtained shows discontinuous, non-uniformly arranged, rectilinear, shaded faded regions with a starlike configuration.

21 Claims, 1 Drawing Sheet

PROCESS FOR FADING DYED TEXTILE PRODUCTS AND FADED PRODUCTS MANUFACTURED ACCORDING TO THE PROCESS

BACKGROUND OF THE INVENTION

The present invention relates to a process for fading dyed textile products in a non-uniform way, and to the resulting faded products obtained by said process.

The term "textile products", as used in the instant specification and in the appended claims, encompasses yarns or threads in skein form or wound on a planar structure, smooth or figured fabrics, cloths such as that cotton cloth which is generally known as "denim", and finished textile articles of manufacture such as trousers (jeans), coats, short overcoats, shirts, blouses, skirts, and so forth.

As is well-known for some fabrics or finished clothing and articles of manufacture, such as, e.g., (denim) cloth, and trousers (jeans), a treatment of artificial aging is desired, which treatment is achieved by carrying out a localized fading or discoloring of the original fabric.

A known method to obtain such an effect is designated "stone wash". Such a process typically involves dipping the textile products into water or into a bath containing a discoloring and/or bleaching chemical agent, such as, e.g., a hypochlorite solution, together with pumice granules or stones having a size generally within the range of from 1 to 10 cm. This process makes it possible to obtain discolored or faded textile products with light to dark contrasting shades at the seams and with uniformity of color in the residual portion of the textile product, typical of the natural wear the fabrics undergo during use.

A process for fading textile articles under dry conditions, i.e., without a dipping in an aqueous bath as it occurs in the "stone wash" process, is known as well. This process, known as "acid wash," was devised by the same applicant of the instant invention, and is disclosed in U.S. Pat. No. 4,740,213. Said process comprises bringing the dyed textile article into contact, by tumbling the article in a non-aqueous environment, with a material such as pumice granules, which has been impregnated with a bleaching chemical agent. The textile material may be in either a wet or dry condition when it comes into contact with the impregnated material.

SUMMARY OF THE INVENTION

The present invention is a new process for fading or discoloring dyed textile products in a discontinuous way.

The process of the present invention makes it possible to obtain a different appearance of the textile product which displays faded stains having different shapes and distribution patterns.

In its broadest aspect, the process of the present invention includes the steps of coating at least the surface of the dyed textile products to be faded with a product resistant to the bleaching and/or discoloring chemical agent, breaking-up such a coating in, typically a random way, thereby generating discontinuous crevices in the coating; and then treating the so obtained broken coating textile product with an aqueous solution of a bleaching and/or discoloring chemical agent.

During such a treatment, the solution of the bleaching and/or discoloring chemical agent penetrates through the crevices and comes into contact with the textile product, generating discontinuous, random, shaded faded regions with a starlike configuration, with an appearance very similar to a sky covered by clouds shattered by lightning.

DETAILED DESCRIPTION OF PREFERRED EMBODIMENTS OF THE INVENTION

Figure 1:
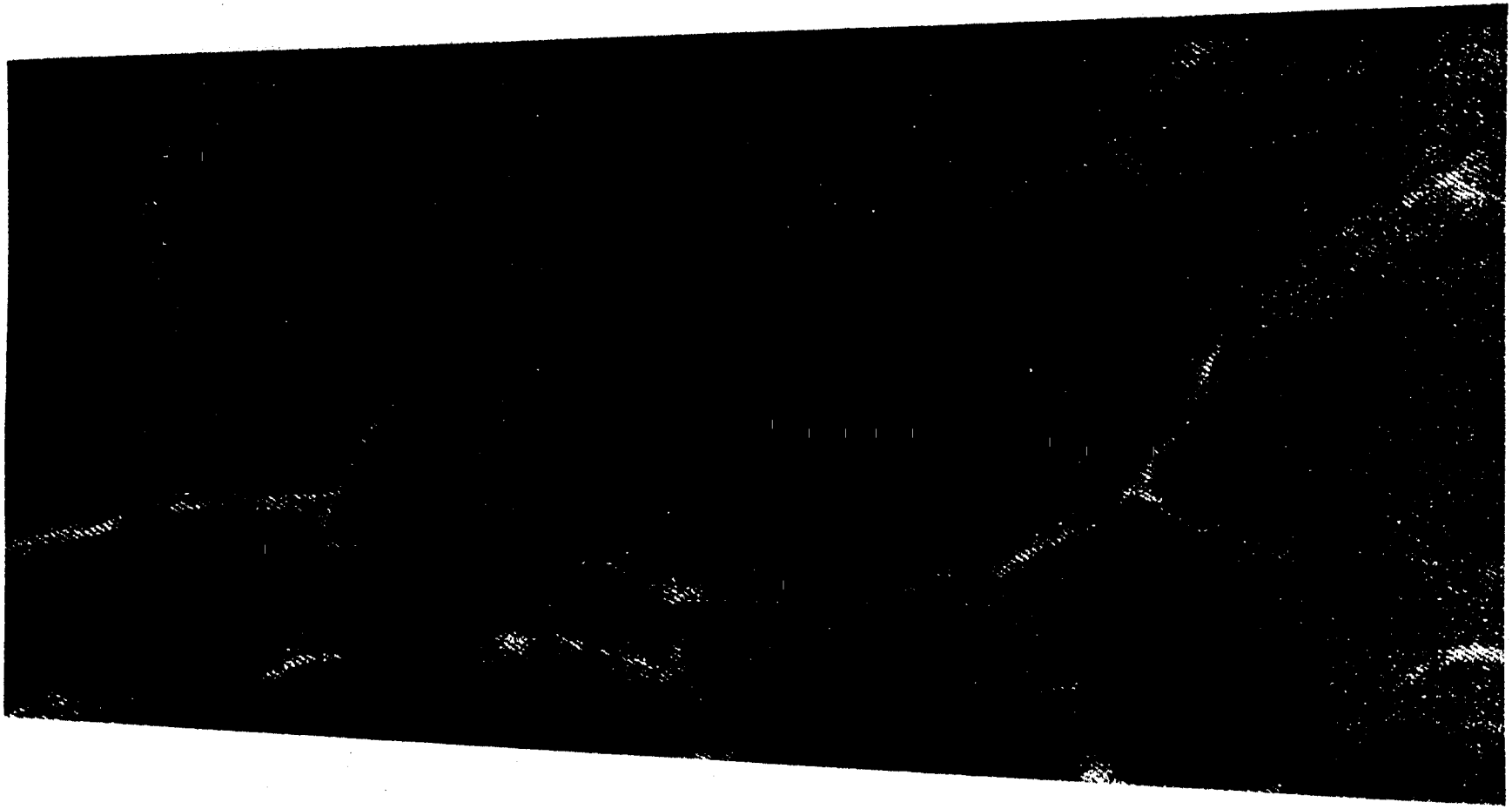
FIG. 1 is a schematic rendition of a textile product of blue denim manufactured according to the process of the invention.

The instant invention provides a process for fading in a non-uniform way, dyed textile products. In a preferred practice the process includes the following steps, carried out generally sequentially:

a. coating at least the surface of the textile product to be submitted to the fading process with a material resistant to the bleaching and/or discoloring chemical agents;
b. breaking-up said coating in a random fashion, and in a plurality of points, while leaving substantial portions of said coating in contact with the textile product;
c. treating the so-obtained broken-coated textile product with an aqueous solution of a bleaching and/or discoloring chemical agent, for a long enough time so as to obtain the desired faded effect;
d. removing or neutralizing any residues of bleaching and/or discoloring chemical possibly remaining on the textile product;
e. drying, and
f. removing the coating material resistant to the bleaching and/or discoloring chemical agents from the textile product.

The breaking up step and the treating step may be performed simultaneously.

Any material resistant to the bleaching and/or discoloring chemical agents can be used in the process according to the present invention. Such a material is applied onto the surface or surfaces of the textile product as a solution or a dispersion, or in the molten state, by spraying, dipping or spreading. Such materials include waxes, resins and glues.

A preferred material resistant to the bleaching and/or discoloring chemical agents is a wax of animal, vegetable, petroleum, mineral or synthetic origin, having a melting or softening point lower than 60° C.

Such waxes are well-known and available from the market; and the composition and structure of typical such waxes is described in Kirk-Othmer, "Encyclopedia of Chemical Technology" Third Edition Vol. 24, pp 466–481.

Examples of waxes which can be used in the process according to the present invention are: bees wax, candelilla wax, carnauba wax, castor wax Japan wax, jojoba wax, montan wax, paraffin, polyethylene waxes, Fischer-Tropsch wax, and so forth. Paraffin is a preferred choice.

Said waxes are preferably applied onto the surface of the textile product in the molten state. For that purpose, a mixer, such as a dryer is used. The textile product and wax are heated in the dryer up to a temperature higher than the softening or melting point of the wax used; temperatures within the range of from 40° C. to 100° C. are generally used. The wax may simply be placed in the dryer in lumps, which soften and become distributed throughout the entire volume. The dryer is caused to tumble for a long enough time to insure that the textile product will be completely coated with the wax in the molten state; in general; such an operation requires from 10 to 100 revolutions of the dryer per minute.

The ratio by weight of the wax (or other material resistant to the bleaching and/or discoloring chemical agents) to the textile material is within the range of from 1:2 to 10:1. In the case of paraffin, a 1:1 ratio is typically employed.

The wax can also be applied by dipping the textile material into molten wax, or into a solution of wax. In the latter case, the solvent in which the wax is dissolved to make the solution will have to be subsequently removed by evaporation.

In any event, cooling or evaporation of the solvent, forms on the surface of the textile material a continuous, brittle layer of wax, or of another, technically similar material resistant to the beaching and/or discoloring chemical agents.

The continuous coating layer is then submitted to a process by which it is broken-up, preferably in a random manner. While the coating layer is broken, it is not broken so much that portions of any significant size detach from the surface of the textile material. The random breaking-up of the coating layer can be carried out in a mixer, such as a washing machine, during the treatment with the aqueous solution of the bleaching and/or discoloring chemical agent. The random breaking may also be carried out as the garments are inserted into the washing machine, or in the washing machine before the aqueous solution is added. For unmade sheet form textiles, the breaking up may also be accomplished by an in-line process, e.g., by running the textiles over a textured roller. The important aspect of the breaking step is that substantially all of the wax is maintained in contact with the textile material and very little, if any, is actually broken free from the textile material.

Any bleaching and/or discoloring chemical agents known to those skilled in the art can be used in the process according to the present invention. In general, such bleaching agents are of an oxidizing type or are chlorine-based. Other known compounds that achieve the desired effect can be used as well.

Non-limiting examples of discoloring and/or bleaching agents are: hypochlorites, such as sodium or potassium hypochlorite, sodium or potassium peroxide, hydrogen peroxide, peroxy acids, sodium hydrosulfite, sodium perborate, potassium permanganate, sodium chlorite, sodium bromite, sodium persulfate, and so forth. Also sodium or potassium hydroxide can be used as well. Sodium hypochlorite and potassium permanganate are the most preferred agents.

The amount of discoloring and/or bleaching agent can vary as a function of the desired discoloring effect. In general, the concentration of the aqueous solution of the bleaching and/or discoloring agent is within the range of from 1% to 50% by weight; and the ratio by weight of solution of discoloring and/or bleaching chemical agent to the textile product is within the range of from 1:1 to 100:1, preferably of from 5:1 to 20:1. The treatment time, i.e., the time of contact of the textile product with the solution of the bleaching or discoloring chemical agent depends on many factors, such as, the desired effect, which may be more or less marked, the concentration of the solution, the temperature of the solution and the type of bleaching chemical agent used.

Contact times within the range of from 10 minutes to 2 hours are generally used with about 15 minutes being preferred in water of 40°. If the water temperature is lower, a longer time is typically used.

After the treatment with the bleaching or discoloring agent, the textile product is submitted to a treatment of neutralization in order to remove any residues of bleaching and/or discoloring chemical agents and is subsequently repeatedly washed with water.

If the discoloring agent is potassium permanganate, a neutralizing bath based on alcali-metal bisulfite or metabisulfite and acetic acid or oxalic acid can be used. If sodium hypochlorite is used, the use of a neutralizing bath based on an anti-chlorine substance such as sodium bisulfite, hydrogen peroxide, and so forth, is recommended.

The textile product is subsequently dried. Any drying temperatures can be used, although in practice the use of temperatures higher than 100° C., e.g., within the range of from 100° C. to 150° C., is preferred.

Finally, the dried textile material is submitted to a treatment to remove the wax or other protecting material.

If a wax is used as the protecting material, its removal can be carried out by dry-cleaning with perchloroethylene, according to conventional cleaning techniques.

By means of the process according to the present invention, only those regions which correspond to the crevices through the coating come into contact with the solution of the bleaching and/or discoloring agent, while the other regions of the fabrics remain sheltered by the coating. Thus, generally rectilinear, typically random shaded faded regions are obtained, which are generally arranged in a starlike configuration, with the discoloring intensity being variable in a random way within a particular faded region and/or between faded regions. By "starlike," it is meant a central bleached region with generally linear bleached rays radiating outward from the central region. The textile product, when considered as a whole, assumes an appearance which is similar to a sky covered with clouds shattered by lightning.

The shaded effect is due to the diffusion of the discoloring and/or bleaching agent through the textile product.

The following example is supplied for illustrative, non-limiting purposes, in order to better understand the present invention.

EXAMPLE

Twelve kg of dry trousers of blue denim cloth (jeans) were charged in a dryer heated at 60° C., together with solid lumps of bees wax in the ratio by weight of trousers:wax of 1:1. The dryer was caused to tumble for 10 minutes at 25 revolutions per minute, with the revolution direction being reversed every 30 seconds. After such a treatment, the trousers were discharged and were allowed to cool.

The wax-coated trousers were then charged in a washing machine and were submitted to a washing process, carried out with an aqueous solution of 4% of sodium hypochlorite. During the treatment, the drum of the washing machine was caused to tumble at the speed of 23–24 revolutions per minute.

The trousers were treated with a solution of 2% of hydrogen peroxide, in order to neutralize or remove any residues of discoloring substance, and then were repeatedly washed with water.

The trousers were then dried at 110°-120° C., and were submitted to cleaning with perchloroethylene, in order to remove the wax.

Each trouser resulted to be faded in a discontinuous and non-uniform fashion, with linear and shaded discolored regions, most of which were arranged in a starlike pattern, and with their color intensity being variable in a random way along each single discolored region, and between discolored regions. The appearance of the trousers, when completely spread, was similar to a sky covered with clouds shattered by lightning.

I claim:

1. A process for fading or discoloring dyed textile products comprising the steps of:

a) charging the dyed textile products to be faded and a wax in a mixer;

b) heating the textile products and said wax in the mixer up to a temperature higher than the softening or melting point of said wax;

c) tumbling said wax and textile products together for a time long enough to secure the complete coating of a surface of the textile products;

d) cooling the textile products coated with said wax and forming a coating that is capable of being broken up to create discontinuous crevices in said coating;

e) breaking-up said coating in a random fashion and in a plurality of locations to generate discontinuous crevices;

f) treating the textile products of step (e) with an aqueous solution of a bleaching and/or discoloring chemical agent selected from the group consisting of sodium hypochlorite and potassium permanganate for a time sufficient to obtain the desired fading effect;

g) removing said bleaching and/or discoloring chemical agents from said textile products;

h) drying the textile product; and i) removing said wax from said textile products.

2. A process for fading or discoloring dyed textile products comprising the steps of:

a) in a mixer, coating a surface of a preselected quantity of dyed textile products with a material resistant to a discoloring or bleaching chemical agent, said resistant material selected from the group consisting of waxes, resins, and glues wherein said coat of resistant material is capable of being broken up to create discontinuous crevices in the coating;

b) breaking-up said coating to generate discontinuous crevices;

c) in a mixer, treating said broken coated textile products with an aqueous solution of a discoloring and/or bleaching chemical agent;

d) removing said bleaching and/or discoloring chemical agent from the textile product;

e) drying the textile product, and f) removing the resistant material from the textile products.

3. The process according to claim 2, in which the material resistant to the bleaching and/or discoloring chemical agents is a wax having a melting or softening point lower than 60° C.

4. The process according to claim 3, in which the wax is selected from the group consisting of bees wax and paraffin.

5. The process according to claim 3, in which said wax is applied onto the surface of the textile product in the molten state.

6. The process according to claim 5, in which said coating step comprises the steps of:

a) charging said wax and said textile product to said mixer;

b) heating said mixer at a temperature within the range of from 40° C. to 100° C.; and c) tumbling said wax ad textile product together for a time long enough to secure the complete coating of the textile product.

7. The process according to claim 1, in which the coating is broken-up in a random way.

8. The process according to claim 1, in which the weight ratio of the material resistant to the bleaching and/or discoloring chemical agent to the textile material is within the range of from 1:2 to 10:1.

9. The process according to claim 1, in which the step of breaking-up the coating layer is carried out during the step of treating the textile product with the aqueous solution of the bleaching and/or discoloring chemical agent.

10. The process according to claim 9, in which the step of breaking-up the coating layer and the step of treating the textile product with the aqueous solution are carried out in a mixer.

11. The process according to claim 1, in which the discoloring and/or bleaching chemical agent is selected from the group consisting of sodium hypochlorite and potassium permanganate.

12. The process according to claim 1, in which the concentration of the aqueous solution of the bleaching and/or discoloring chemical agent is within the range of from 1 to 50% by weight.

13. The process according to claim 12, in which the weight ratio of the solution of the discoloring and/or bleaching chemical agent to the textile product is within the range of from 1:1 to 100:1, and the contact time of said step of treating the textile product with an aqueous solution is within the range of from 10 minutes to 2 hours.

14. The process of claim 13, said weight ratio of the solution of discoloring and/or bleaching chemical agent to the textile product is within the range of from 5:1 to 20:1.

15. The process according to claim 2, in which the drying step is conducted at a temperature higher than 100° C.

16. The process of claim 15, in which the drying step is conducted at a temperature of between 100° C. to 150° C.

17. The process according to claim 2, in which the step of removing the material resistant to the bleaching and/or discoloring chemical agents is accomplished by dry cleaning.

18. A non-uniform faded textile product obtained by the process comprising the steps of:

a) charging the dyed textile products to be faded and a wax in a mixer;

b) heating the textile products and said wax in the mixer up to a temperature higher than the softening or melting point of said wax;

c) tumbling said wax and textile products together for a time long enough to secure the complete coating of a surface of the textile products;

d) cooling the textile products coated with said wax and forming a coating that is capable of being broken up to create discontinuous crevices in said coating;

e) breaking-up said coating in a random fashion and in a plurality of locations to generate discontinuous crevices;

f) treating the textile products of step (e) with an aqueous solution of a bleaching and/or discoloring chemical agent selected from the group consisting of sodium hypochlorite and potassium permanganate for a time sufficient to obtain the desired fading effect;

g) removing said bleaching and/or discoloring chemical agents from said textile products;

h) drying the textile product; and i) removing said wax from said textile products.

19. A non-uniform faded textile product obtained by the process comprising the steps of:

a) in a mixer, coating a surface of a preselected quantity of dyed textile product with a material resistant to a discoloring and/or bleaching chemical agent;

b) breaking-up said coating to generate discontinuous crevices and c) in a mixer, treating the so obtained textile products with an aqueous solution of said discoloring and/or bleaching chemical agent.

20. A process for fading or discoloring dyed textile products comprising the steps of:

a) coating a surface of a preselected quantity of dyed textile products to be faded with a material resistant to a bleaching chemical agent;

b) breaking-up said coating to generate discontinuous crevices; and c) treating the so-obtained textile products with an aqueous solution of said bleaching chemical agent.

21. The process of claim 20 wherein said coating step is conducted in a mixer, said breaking up is in a random fashion and said treating step is conducted in a mixer.

* * * * *